US011940242B1

(12) United States Patent
Rentz

(10) Patent No.: US 11,940,242 B1
(45) Date of Patent: Mar. 26, 2024

(54) HANDHELD THUMB TRIGGER ARCHERY RELEASE

(71) Applicant: Gregory E. Summers Trust Agreement, Madison Heights, VA (US)

(72) Inventor: Marc Rentz, Madison Heights, VA (US)

(73) Assignee: Gregory E. Summers Trust Agreement, Madison Heights, VA (US)

( * ) Notice: Subject to any disclaimer, the term of this patent is extended or adjusted under 35 U.S.C. 154(b) by 0 days.

(21) Appl. No.: 18/145,956

(22) Filed: Dec. 23, 2022

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 3,397,206 A * 8/1968 Nicolaisen ..... C07D 251/36 252/187.34
4,004,564 A * 1/1977 Castonguay ..... F41B 5/1469 124/35.2
5,103,796 A * 4/1992 Peck ..... F41B 5/1469 124/35.2
5,694,915 A * 12/1997 Summers ..... F41B 5/1469 124/35.2
6,571,786 B2 * 6/2003 Summers ..... F41B 5/1469 124/35.2
6,584,966 B1 * 7/2003 Summers ..... F41B 5/1469 124/35.2
6,631,709 B2 * 10/2003 Carter ..... F41B 5/1469 124/35.2
6,647,976 B2 * 11/2003 Summers ..... F41B 5/1469 124/35.2
6,953,035 B1 * 10/2005 Summers ..... F41B 5/1469 124/35.2
8,622,051 B2 * 1/2014 Summers ..... F41B 5/1469 124/35.2
8,997,729 B1 * 4/2015 Gillig ..... F41B 5/1469 124/35.2
9,027,540 B2 * 5/2015 Springer ..... F41B 5/1469 124/90
9,557,133 B2 * 1/2017 Rentz ..... F41B 5/1469
9,599,428 B2 * 3/2017 Trpkovski ..... F41B 5/1469
9,702,658 B2 * 7/2017 Horn ..... F41B 5/1469
9,970,971 B2 * 5/2018 Jungwirth ..... G01R 19/0046
9,982,961 B1 5/2018 Rentz
10,436,544 B1 * 10/2019 Jones ..... F41B 5/1469
10,731,943 B2 * 8/2020 Horn ..... F41B 5/1469
11,067,356 B2 * 7/2021 Haas ..... F41B 5/1469
11,353,281 B1 6/2022 Rentz
2011/0168146 A1 * 7/2011 Deceuster ..... F41B 5/1469 124/80

* cited by examiner

*Primary Examiner* — John A Ricci
(74) *Attorney, Agent, or Firm* — LAUBSCHER & FRETWELL, P.C.

(57) ABSTRACT

A handheld archery release of the thumb trigger type includes an adjustment screw for displacing the head of the release toward and away from the release handle to quicken or slow the firing action of the release. The head holds a bowstring until activation of a sear assembly in the handle by a trigger assembly connected with the handle. Adjustment of the head is accomplished independently of the release assembly.

13 Claims, 11 Drawing Sheets

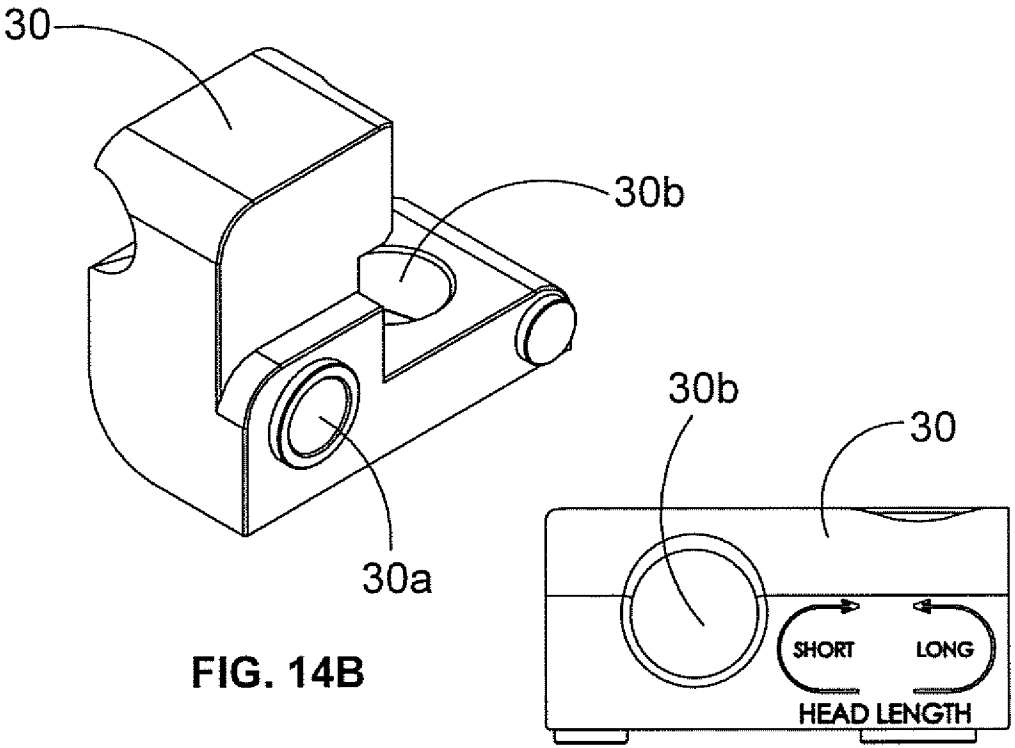
FIG. 14B
FIG. 14C
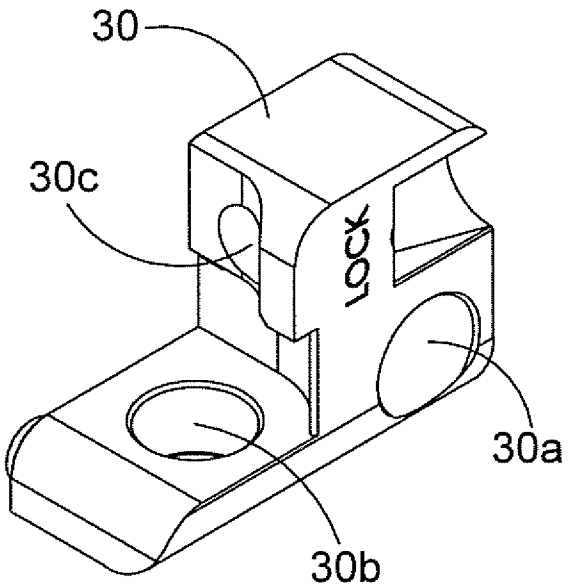
FIG. 14A

HANDHELD THUMB TRIGGER ARCHERY RELEASE

BACKGROUND OF THE INVENTION

The present invention relates to an archery release, and more particularly to a handheld thumb trigger archery release including an adjustable head.

Release devices are used in archery to assist the archer in pulling a bowstring to a fully drawn position and then releasing the bowstring to fire an arrow. Some release devices use grippers for engaging a bowstring or a hock mounted on the bowstring. Other release devices use a rope looped around the bowstring. Handheld releases are generally of two types, using either a trigger or back tension to fire the shot. As a result or repeated firing of a shot, the release point as to when a shot is fired can be altered by a number of factors such as a worn loop or stretching of the bowstring. Accordingly, slight in or out adjustment of the release helps to quicken or slow the firing sequence to compensate for changes in the release point.

An archers draw length is a learned location position the archer performs by touch points along the jaw, chin, nose or neck and is not supposed to change. Most archers choose to have three points of contact that provide all three axes of the release to be repetitiously and consistently accurately achievable. The changes in the release head length effectively lengthen or shorten the culmination of both the bow draw length and the archer's anchor point location position. This is similar to lengthening or shortening a D-Loop that is tied onto a bowstring which the release connects too to then fire the shot. The present invention provides quick head length adjustability to a thumb trigger release by tightening or loosening a single screw. Previously, such adjustment was done by twisting a bowstring while a bow is in a bow-press to shorten or lengthen the bow string or by removing and re-tying on a shorter or longer D-Loop. These prior techniques make it difficult to achieve an accurate head length adjustment.

BRIEF DESCRIPTION OF THE PRIOR ART

Back-tension or hinge type release devices are well-known in the prior art as evidenced by U.S. Pat. No. 11,353,281 which discloses a handheld back tension archery release which affords adjustment of the release head length. The sear assembly is mounted on the head of the release which is adjustably connected with the release handle. That is, the head and sear assembly may be moved toward and away from the handle to achieve a more consistent archer anchor or release point within the range of bow draw length, effectively maintaining consistent pressure exerted on the bow limbs when at full draw to execute the shot. When the head length is shortened, the back-tension process begins earlier with greater pressure on the bow limbs, resulting in the shot going off quicker. When the head length is lengthened, the back-tension process begins later with less pressure upon the bow limbs, resulting in the shot going off slower. The in and out adjustment of the head length provides the archer with better control of the shot process timing, thus improving accuracy.

U.S. Pat. No. 9,982,961 discloses an archery release which is convertible between hinge and trigger operation. In the hinge mode of operation, the release position of the sear assembly is adjusted via a micro screw. However, in a trigger mode of operation, the release position of the sear assembly is not adjustable.

Coarse adjustment of the trigger relative to the handle of a release is possible to adjust the release point of the sear. The present invention was developed in order to overcome the drawbacks of existing trigger style handheld releases by providing such a release with head length adjustability to give the archer greater control of shot timing at the release point by making changes that vary the bow limb pressure to speed up or slow down the shot.

SUMMARY PF THE INVENTION

Accordingly, it is a primary object of the invention to provide an archery release including a handle, a sear assembly connected with the handle, a trigger assembly connected with the handle for operating the sear assembly, and a head assembly adjustably connected with handle. The head assembly holds and releases a bow string when activated by the trigger and sear assembly. By adjusting the head assembly relative to the handle, an archer is able to adjust the release point of the sear to slow or quicken the firing sequence of a shot.

Adjustment of the head assembly toward and away from the handle is accomplished with an adjustment screw connected with the handle. More particularly, the head assembly includes a head, the lower portion of which contains a cavity configured to match a contour of a portion of the handle. The head further contains a threaded opening which receives a threaded end of the adjustment screw. Rotation of the screw displaces the head relative to the handle in a sliding manner independent of the sear assembly. In order to limit the extent to which the head assembly may be displaced away from the handle, a side wall of the head contains a through slot which communicates with the cavity. A stop mechanism is connected the handle and extends into the head through slot.

A locking assembly is connected with the handle and operable to prevent rotation of the adjustment screw once the head assembly has been adjusted. The locking assembly includes a synthetic plastic ball arranged in a channel and a set screw which is operable to press the ball against a portion of the adjustment screw to prevent the screws from rotating.

A bail and bail keep of the head assembly hold and release a bowstring to fire a shot. The sear assembly includes sear and toggle elements which are pivotally connected with the handle. Actuation of the trigger assembly pivots the sear which pivots the toggle to pivot the bail keep and release the bail. The toggle has an extension at one end which is engaged by a projection of the bail keep. The bail keep projection slides along the toggle extension during displacement of head assembly relative to the handle to adjust the release position without displacing the sear assembly.

BRIEF DESCRIPTION OF THE FIGURES

Other objects and advantages of the invention will become apparent from a study of the following specification when viewed in the light of the accompanying drawing, in which:

FIGS. 14*a*, 14*b*, and 14*c* are front perspective, rear perspective and bottom plan views, respectively, of the head adjustment lock member of the archery release;

DETAILED DESCRIPTION

Figure 2:
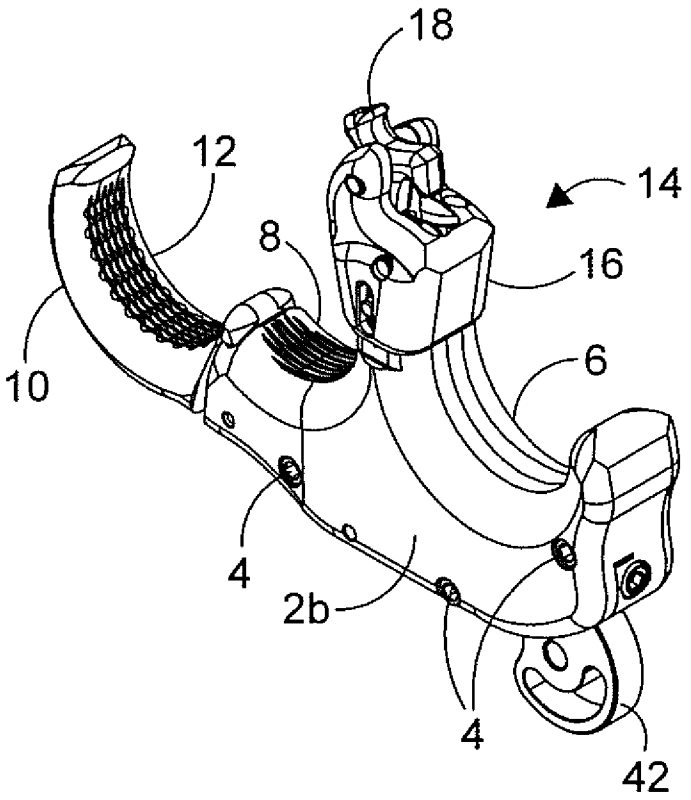
FIGS. 1 and 2 are front and rear perspective views, respectively, of the archery release according to the invention.
Figure 1:
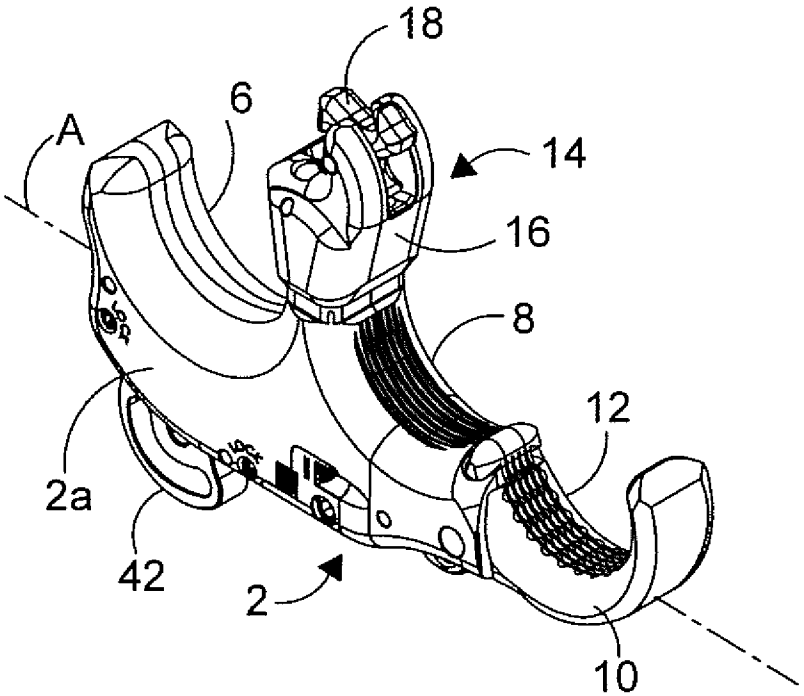

The handheld thumb trigger archery release according to the invention is shown in FIGS. 1 and 2. The release includes a handle 2 having a longitudinal axis A. The handle is formed from two mating generally concave sections 2*a*, 2*b* which when joined define a chamber within the handle as shown in FIGS. 3-6. The handle sections contain openings which are aligned when the sections are brought together in contiguous relation for receiving screws 4 or other fastening devices to connect the handle sections together. The handle includes concave recesses in one surface thereof for receiving the fingers of an archer. A first recess 6 is adapted to receive the index finger of the archer and a second recess 8 is adapted to receive the middle finger. An optional finger support 10 containing a concave recess 12 may be provided to receive the ring finger. The finger support is adjustably connected with the handle as will be developed below.

Between the first 6 and second 8 finger recesses, the first and second handle sections 2*a*, and 2*b* include a contoured projection 2*c*, 2*d*, respectively, which when joined form a contoured projection on which a head assembly 14 is arranged. The head assembly includes a head 16, a bail 18 rotatably connected with the head and a bail keep 20 pivotally connected with the head.

Figure 13C:
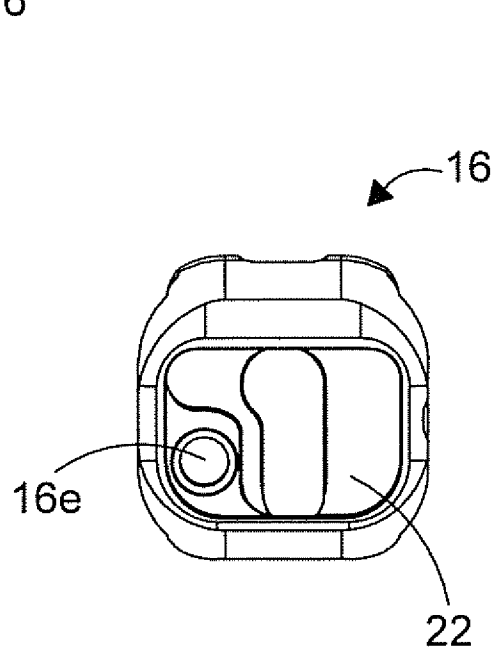
FIGS. 13*a*, 13*b*, and 13*c* are front top perspective, rear bottom perspective and bottom plan views, respectively, of the head of the archery release.
Figure 13B:
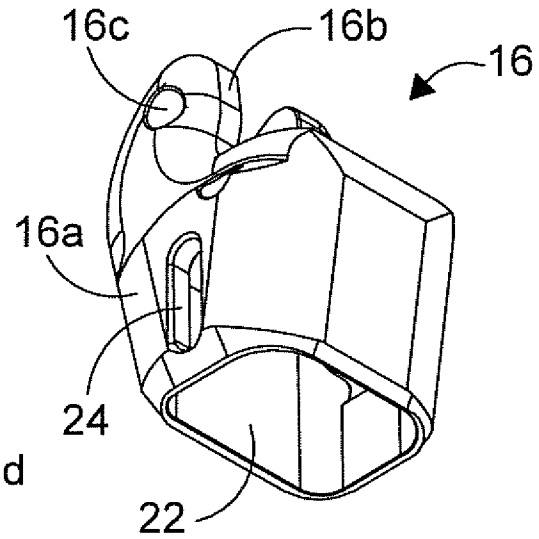
Figure 13A:
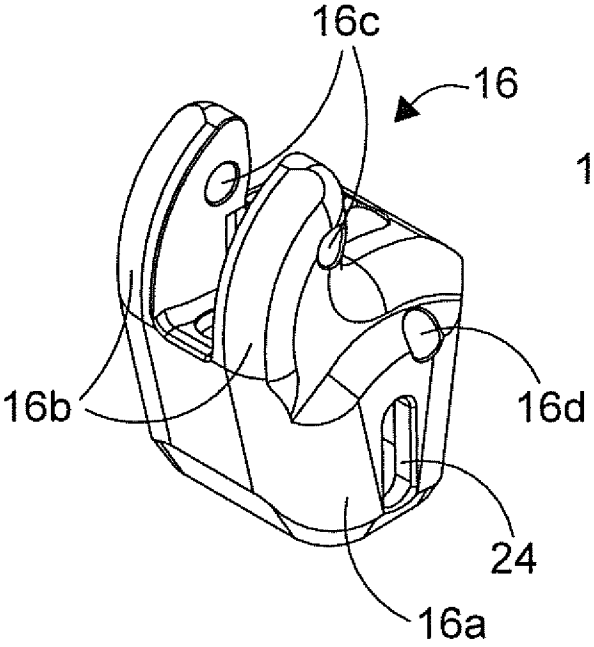
Figure 19:
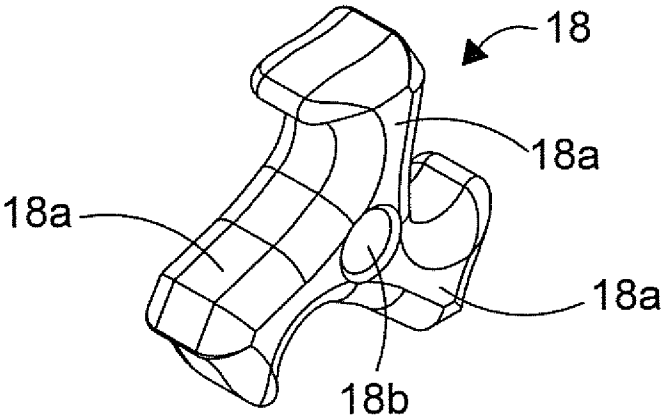
FIG. 19 is a perspective view of the bail of the archery release.
Figure 20:
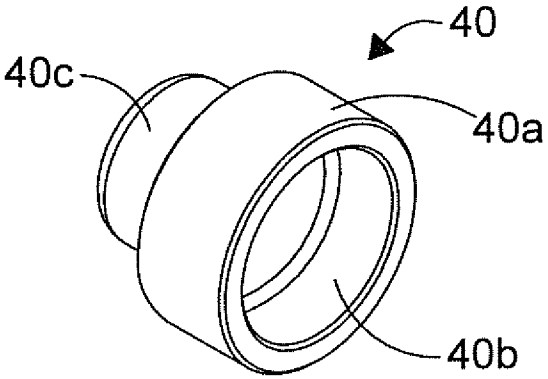
FIG. 20 is a perspective view of the end cap of the head stop mechanism of the archery release.

The head 16 is shown more particularly in FIGS. 13*a*-13*c*. The bottom portion of the head contains a cavity 22 and one side wall 16*a* contains a through slot 24 which extends from a bottom portion of the side wall 16*a* and communicates with the cavity. The top of the head includes a spaced pair of projections 16*b* between which the bail 18 is mounted. The bail is shown in detail in FIG. 19. It preferably includes three hook portions 18*a* and contains a lateral opening 18*b*. The head projections 16*b* each contain aligned openings 16*c*. As shown FIGS. 5 and 6, a dowel pin 25 passes through the head projection openings 16*c* and the bail opening 18*b* so that the bail is rotatable relative to the head as will be described below.

Figure 5:
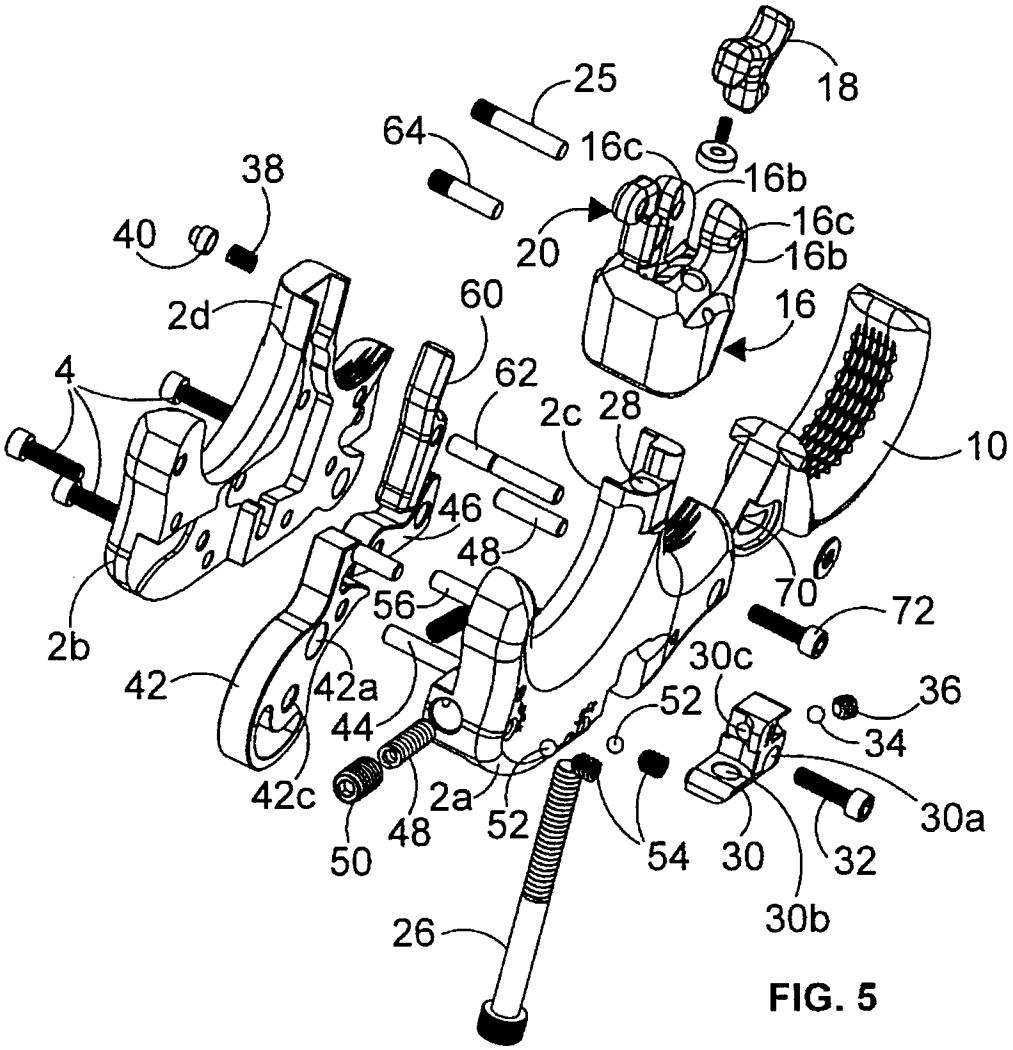
FIG. 5 is an exploded front view of the archery release.
Figure 6:
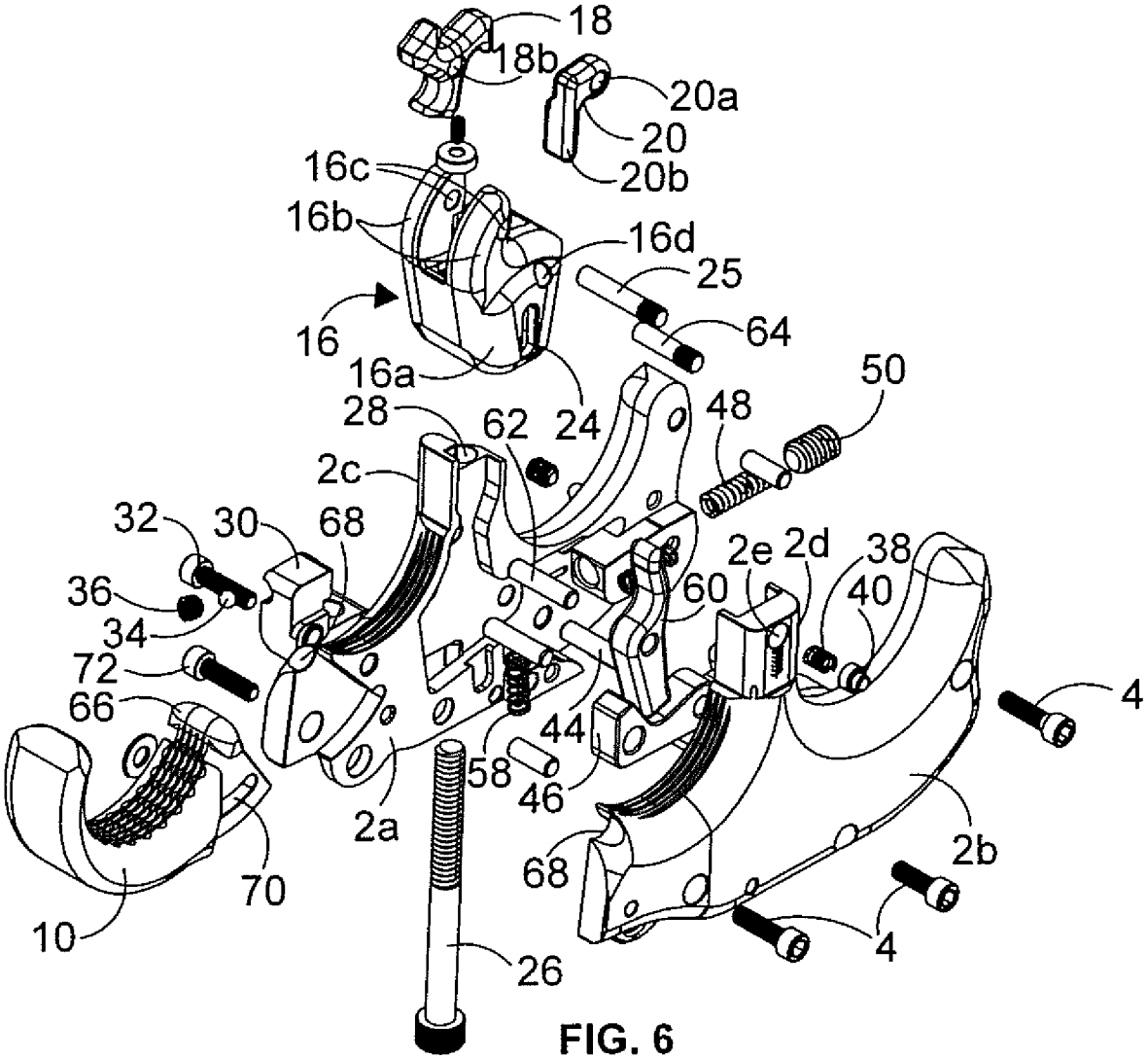
FIG. 6 is an exploded rear view of the archery release.
Figure 8:
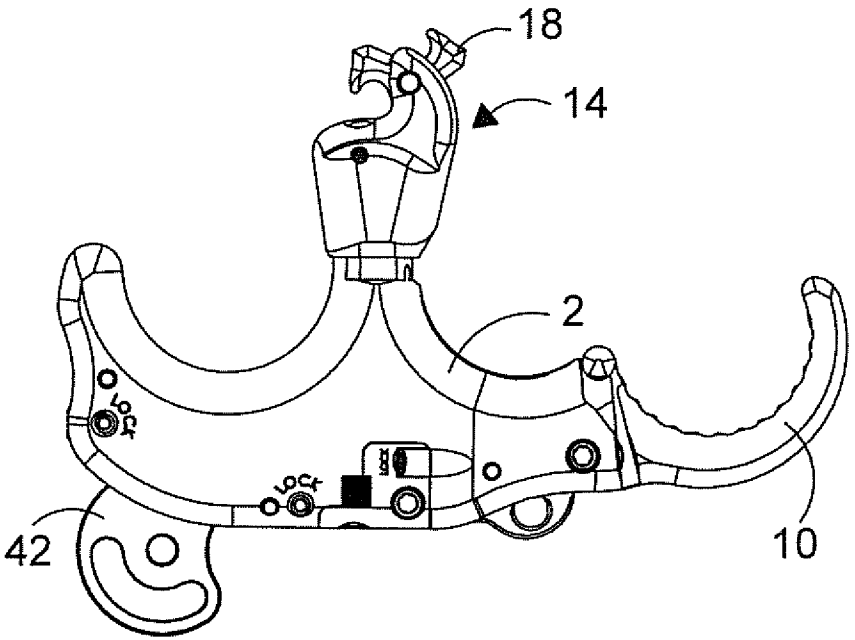
FIGS. 7 and 8 are front plan views of the release with the head assembly adjusted to extended and retracted positions, respectively.
Figure 7:
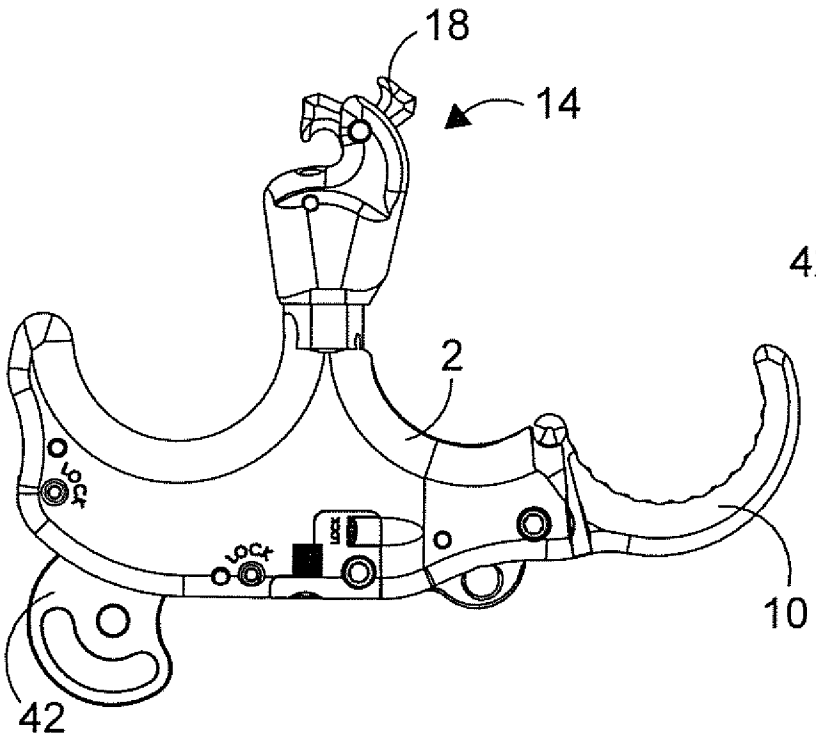

The head assembly 14 is adjustably connected with the handle 2 for movement relative to the handle axis. In this regard, an adjustment screw 26 is arranged in a channel in the handle section 2*b* as shown for example in FIG. 3. A threaded end of the screw extends from a through opening 28 in the protection 2*c* of the handle section 2*a* which is shown in FIGS. 5 and 6. The threaded end of the screw further extends into a threaded opening 16*e* in the bottom of the head 16 which is shown in FIG. 13*c* when the head is positioned on the projection of the assembled handle. Rotation of the screw 26 in a first direction displaces the head upwardly away from the handle 2 and its axis A to an extended position as shown FIG. 7. Rotation of the screw in a second direction opposite the first direction displaces the head downward toward the handle and its axis to a retracted position as shown in FIG. 8. Other than rotation, screw 26 remains stationary within the handle. The matching contours of the head cavity 22 and the handle protection afford smooth sliding movement of the head and the entire head assembly relative to the handle.

Figure 12:
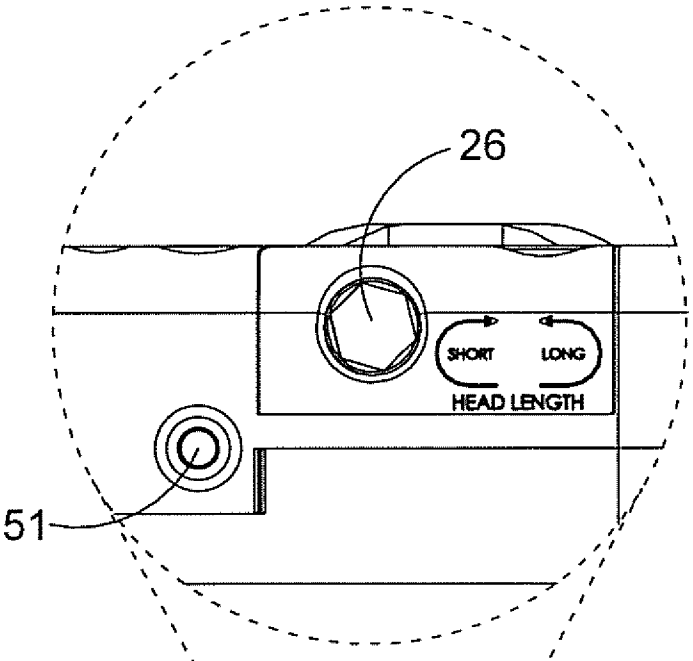
FIG. 12 is a detailed view of a portion of the archery release of FIG. 11.
Figure 11:
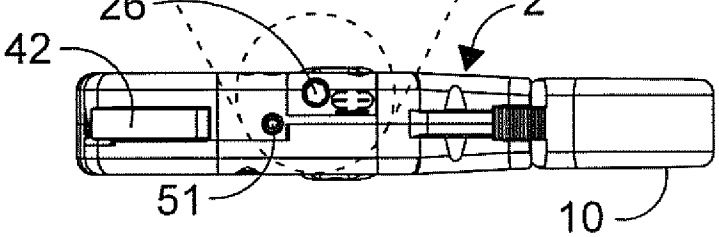
FIG. 11 is a bottom plan view of the archery release.

Rotation of the screw can be prevented through use of a locking member 30 which is shown in detail in FIGS. 14*a*-14*c*. The locking member in connected with the handle section 2*a* via a screw 32 which passes through a lateral opening 30*a* in the locking member and into a threaded opening in the handle section. A further opening 30*b* affords access to the head of the adjustment screw with a tool to rotate the screw as shown in FIGS. 11 and 12. The locking member 30 further contains a longitudinal opening 30*c* at least a portion of which is threaded and which is configured to receive a synthetic plastic ball 34 and a set screw 36. Loosening at the set screw 36 frees the adjustment screw 26 for rotation to move the head to a desired position. Tightening of the set screw presses the ball 34 against adjustment screw to prevent the adjustment screw from rotating. This securely retains the head assembly in the set position. The locking member is further configured as a keeper for the adjustment screw.

Figure 4:
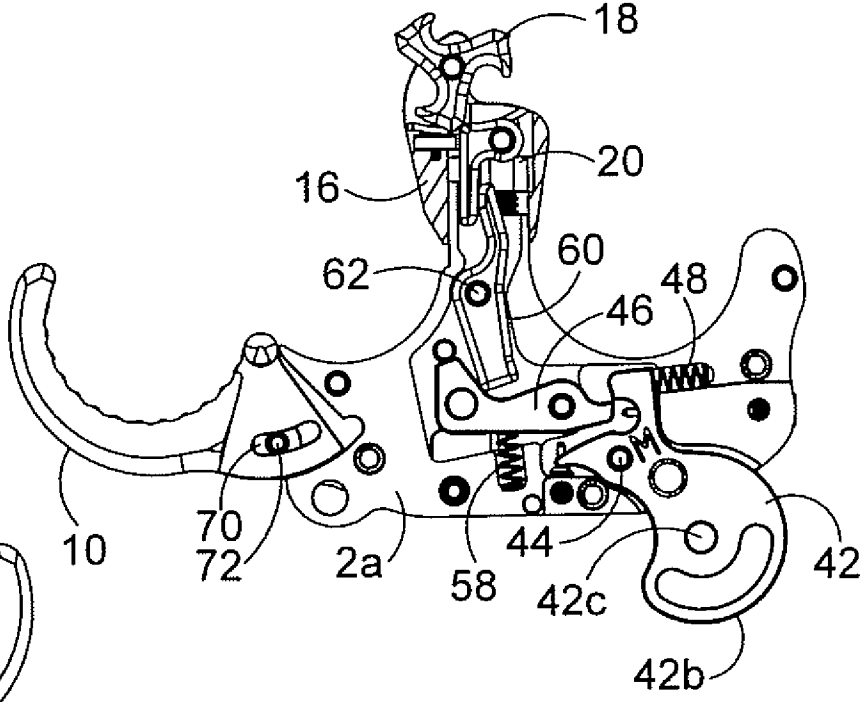
FIGS. 3 and 4 are partial sectional front and rear plan views, respectively, the archery release.
Figure 3:
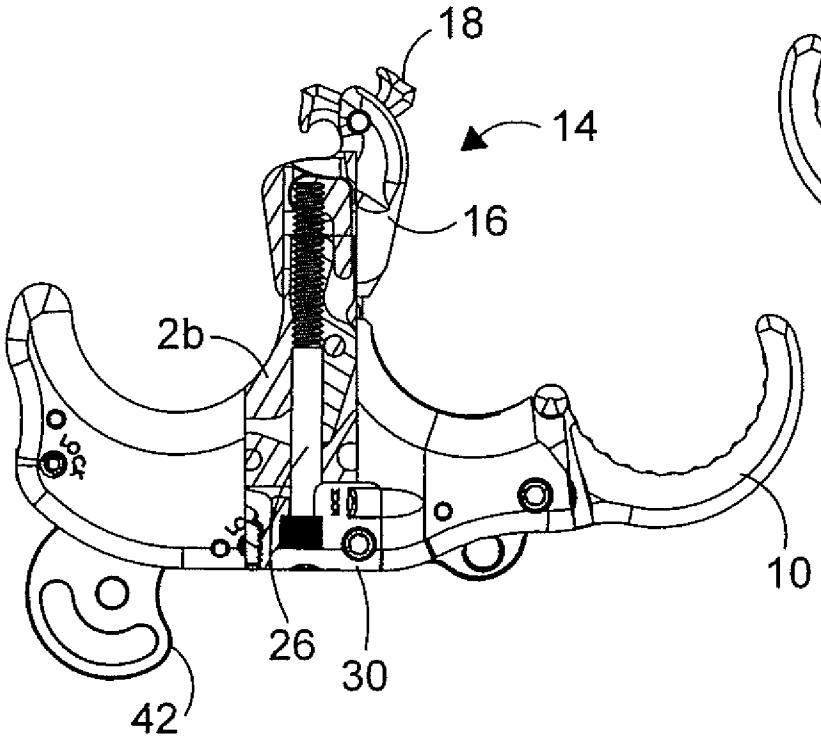
Figure 10:
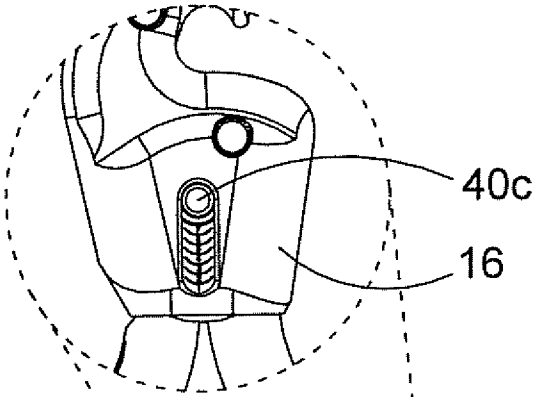
FIG. 10 is a detailed view of a portion of the head assembly of the archery release of FIG. 9.
Figure 9:
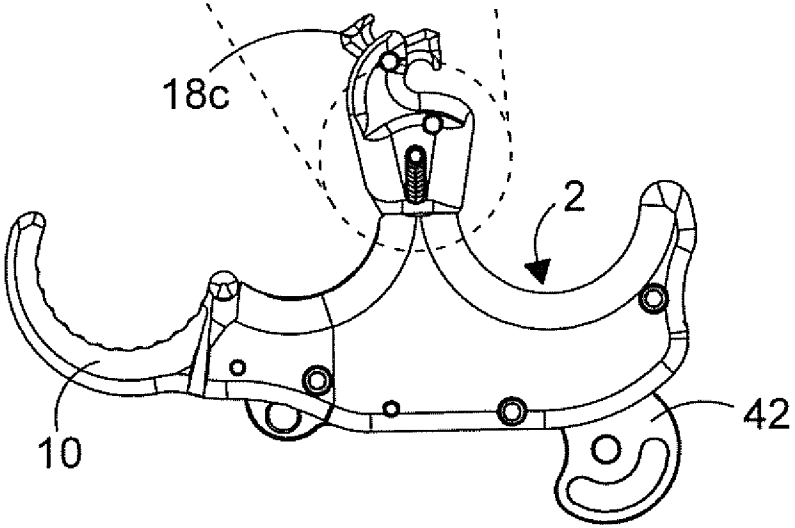
FIG. 9 is a rear plan view of the release with the head assembly in the retracted position.

Displacement of the head assembly relative to the handle is limited by a stop assembly which cooperates with the through slot 24 in the head 16. More particularly, the projection 2*d* of the handle section 2*b* contains a lateral through opening 2*e* as shown in FIG. 6. A spring 38 is arranged in the opening 2*e* and held in place by an end cap 40. As shown in FIG. 4, the end cap has a first portion 40*a* containing a cavity 40*b* and having an outer diameter which corresponds with the inner diameter of the opening 2*e*. The diameter of the cavity corresponds with the diameter of the spring. The end cap 40 has a second portion 40*c* of smaller diameter which acts as a pill arranged in the slot 24 of the head 16 as shown in FIG. 10. The end cap is assembled within the head 16 with the larger diameter first portion 40*a* having a slip fit tolerance in the hole 2*e* of the handle section projection 2*d*. The smaller diameter second portion 40*c* of the end cap 40 faces outward and projects into the slot 24 of the head due to bias of the spring 38 when fully assembled. Thus, the second portion 40*c* of the end cap acts as a stop to limit the extended and retracted positions of the head assembly relative to the handle.

Figure 15B:
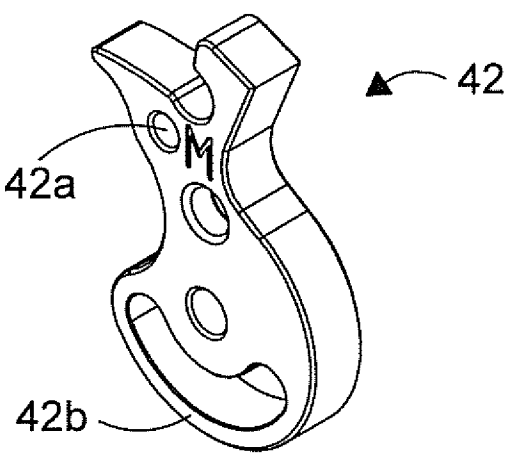
FIGS. 15*a* and 15*b* are front and rear perspective views, respectively, of the trigger of the archery release.
Figure 15A:
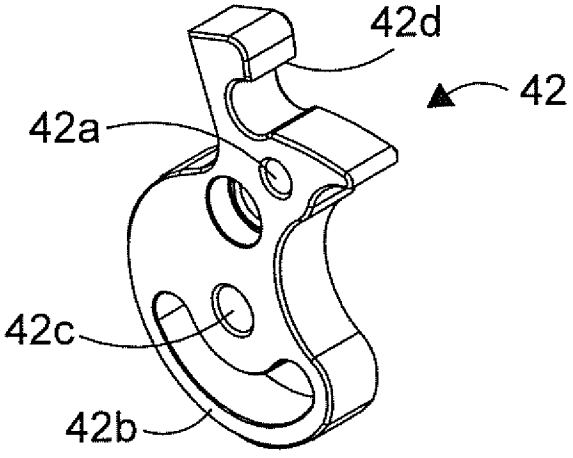

Operation of the release to fire an arrow will now be described. A trigger assembly and a sear assembly are connected with the handle. Referring to FIGS. 4-6, the trigger assembly includes a trigger 42 pivotally connected with the handle section 2*a* via a dowel 44. The trigger is shown in detail in detail in FIGS. 15*a* and 15*b*. The trigger is preferably a thumb trigger. It contains an opening 42*a* for receiving the dowel 44. As shown in FIG. 4, a first portion 42*b* of the trigger extends from the handle via an opening in the handle sections. The first portion of the trigger contains an opening 42*c* within which a thumb pin (not shown) may be connected. The thumb pin may be connected with either side of the trigger for use by right or left-handed archers. Opposite the first portion, the trigger includes a catch portion 42*d* which is configured to engage a catch portion 46*b* sear 46 as will be described below. A spring 48 in the handle section 2*a* presses against the trigger to retain it in a hold or catch position. A set screw 50 retains the spring 48 in the handle section. Tension may be applied to the trigger to control to degree or ease with which the trigger may be activated by the archer to fire a shot. Travel of the trigger is adjusted by a screw (not shown) arranged in a threaded opening 51 in the bottom of the handle 2 which is shown in FIGS. 11 and 12. In this regard, spaced nylon balls 52 are arranged in openings in the handle section 2*a* and are pressed against the pressure adjustment screw 50 and the trigger travel adjustment screw by set screws 54 to prevent the pressure adjustment and trigger travel screws from moving during use.

Figure 16B:
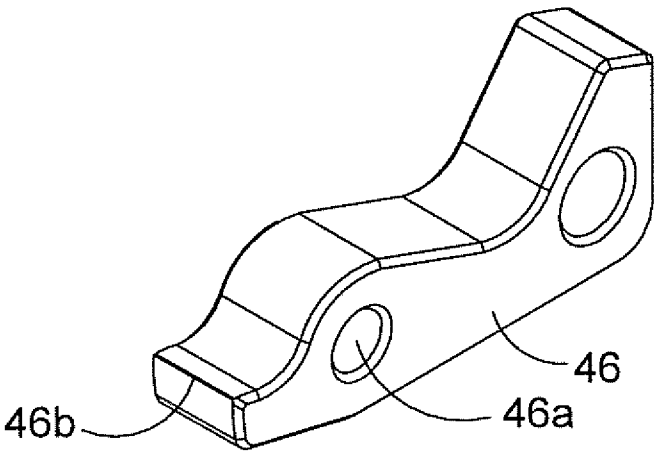
FIGS. 16*a* and 16*b* are front and rear perspective views, respectively, of the sear of the archery release.
Figure 16A:
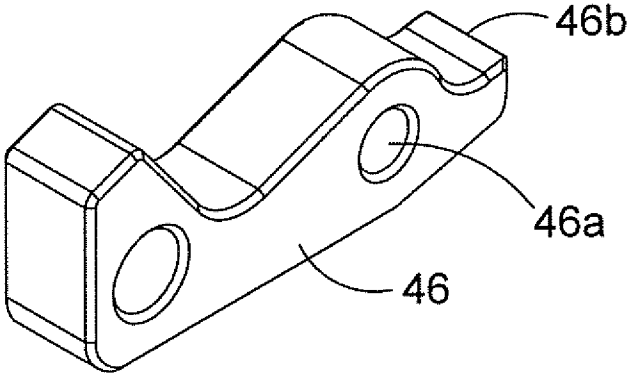

The sear assembly is connected with the handle section 2*a* as shown in sear 46. As shown in FIGS. 16*a* and 16*b*, the sear has a generally L-shaped configuration and contains an opening 46*a* which receives a dowel pin 56 to pivotally connect the sear with the handle section 2*a* for pivotal movement about an axis normal to the longitudinal axis A of the handle. At an end of the sear remote from the opening 46*a* is provided a catch portion 46*b* which is retained by the catch portion 42*d* of the trigger as shown in FIG. 4. A spring 58 in the handle biases the sear 46 in a clockwise direction of rotation.

Figure 17B:
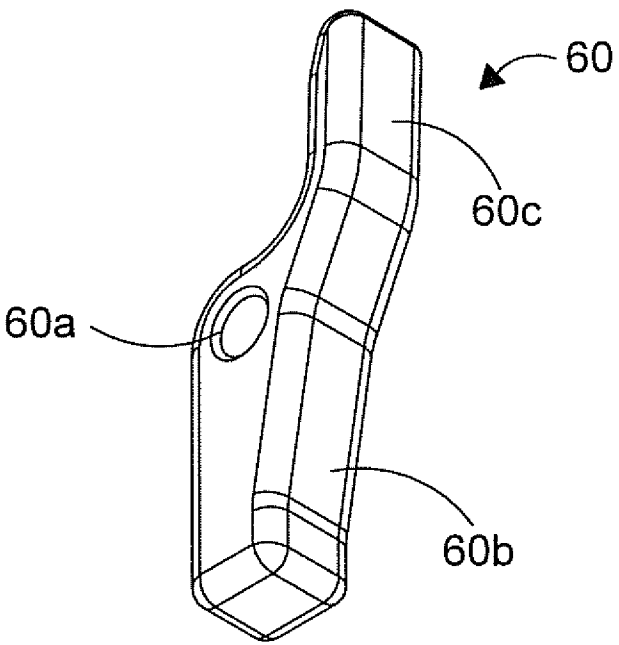
FIGS. 17*a* and 17*b* are front and rear perspective views, respectively, of the toggle of the archery release.
Figure 17A:
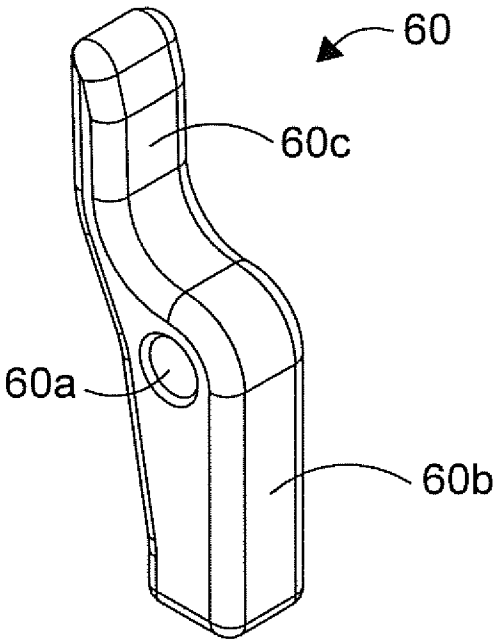

The sear assembly further includes a toggle 60 pivotally connected with the handle section 2*a* via a dowel 62 which passes through an opening 60*a* in the toggle. The dowel affords pivotal movement of the toggle about an axis parallel with the axis of the trigger. The toggle is shown in detail in. FIGS. 17*a* and 17*b*. Extending from the opening 60*a*, the toggle includes a lower extension or leg 60*b* which abuts against a portion of the sear 46 as shown FIG. 4 and an upper extension of leg 60*c* which is configured to engage the bail keep 20 of the head assembly 14.

Figure 18A:
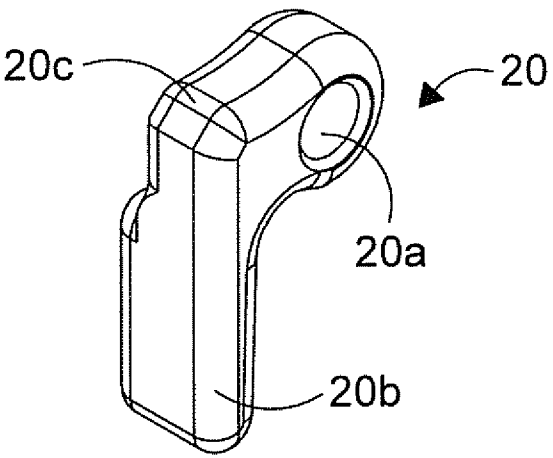
FIGS. 18*a* and 18*b* are front and rear perspective views, respectively, of the bail keep of the archery release.
Figure 18B:
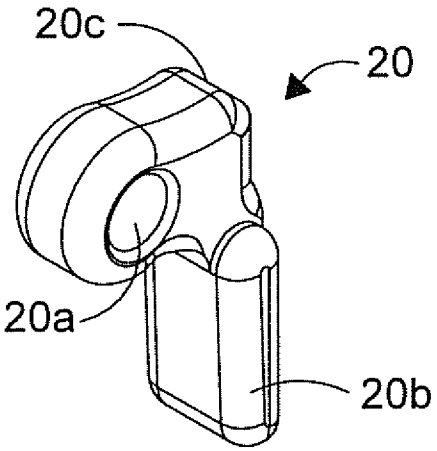

As set forth above, the head assembly 14 include a bail keep 20. The bail keep is shown in detail in FIGS. 18*a* and 18*b*. It has a generally L-shaped and contains an opening 20*a* in an upper portion which received a dowel 64 which pivotally connects the bail keep with head 16 of the head assembly. More particularly, the head contains a further opening 16*d* as best shown in FIGS. 6 and 13*a* to receive the bail keep dowel 64. The bail keep further includes a lower leg portion 20*b* against which the upper leg 60*c* of the toggle rests. The bail keep further includes an edge 20*c* configured to engage or release a remote edge of a hook 18*a* of the bail 18.

In use, the trigger 42 of the release is retained in catch position by the spring 48 and the sear assembly is in the hold position. A bow loop or bowstring is arranged on a hook of the bail 18. With reference to FIG. 4, as the archer draws the bow loop or string back, tension of the string exerts a force on the bail in the counterclockwise direction which presses the edge of the adjacent hook under and against the edge 20*c* of the bail keep to create a counter-clockwise force on the bail keep. This in turn biases the lower leg 20*b* of the bail keep against the upper leg 60*c* of the toggle to generate a clockwise force on the toggle. The clockwise force on the toggle lower end in turn presses the toggle lower end against the sear to bias the sear in a counterclockwise direction, with the sear being held in position by the trigger. Activation of the trigger releases the sear, the toggle, and the bail keep to release the bail which rotates through approximately 120° to release the bowstring.

Adjustment of the head relative to the handle is possible without a need to re-adjust the trigger travel setting or the trigger tension setting. The remain secure throughout the head adjustment. Owing to the lengths of the toggle upper leg 60*c* and the bail keep lower leg portion 20*b*, there is sufficient overlap of these elements that they maintain contact during adjustment of the head as the bail keep lower leg portion slides along the toggle upper leg.

It will be appreciated that the two handle sections 2*a*, 2*b* when connected define a cavity within the handle in which the sear assembly and at least a portion of the trigger assembly are arranged. Dowel pins may be provided at various locations within the cavity, the opposite ends of the pins being arranged in corresponding cavities in each section to help maintain the structural integrity of the handle during use of the release.

The finger support 10 is connected with the handle via a hinge connection. That is, the finger support includes a hinge pin portion 66 that rests in a recess 68 in the handle sections 2*a* and 2*b*. A slot 70 in the finger support is arranged below the hinge pin portion. The slot is aligned with aligned threaded openings in the handle sections. An adjustment screw 72 passes through the slot into the threaded openings to secure the finger at a selected angle relative to the handle at the preference of the archer.

While the preferred forms and embodiments of the invention have been illustrated and described, it will become apparent to those of ordinary skill in the art that various changes and modifications may be made without deviating from the inventive concepts set forth above.

What is claimed is:

1. An archery release, comprising (a) a handle having a longitudinal axis;

(b) a sear assembly connected with said handle and operable between hold and fire positions; and (c) a trigger assembly pivotally connected with said handle for operating said sear assembly; and (d) head assembly connected with said sear assembly and operable to hold and release a bowstring, said head assembly being adjustably connected with said handle for movement relative to said longitudinal axis.

2. An archery release as defined in claim 1, wherein said head assembly includes a head containing a threaded opening and a adjustment screw rotatably connected with said handle, a threaded end of said adjustment screw engaging said head threaded opening to displace said head relative to said handle upon rotation of said adjustment screw.

3. An archery release as defined in claim 2, and further comprising an adjustment screw locking assembly connected said handle and engaging said adjustment screw to lock said adjustment screw in a selected rotational position relative to said handle, thereby locking said head in a selected position relative to said handle.

4. An archery release as defined in claim 2, wherein said head contains a through slot in a side wall thereof and said handle includes a stop mechanism which engages said head through slot to limit displacement of said head in a direction away from the longitudinal axis.

5. An archery release as defined in claim 3, wherein said head contains a cavity for receiving a portion of said handle.

6. An archery release as defined in claim 5, wherein said head cavity is configured to match a contour of said handle portion, whereby said head slides relative to said handle during displacement.

7. An archery release as defined in claim 2, wherein said head assembly includes a bail rotatably connected with said head and wherein said sear assembly is operable to release said bail for rotation upon operation of said trigger assembly.

8. An archery release as defined in claim 7, wherein said head assembly further includes a bail keep pivotally connected with said head and arranged between said bail and said sear assembly for retaining said bail from rotation and for releasing said bail upon operation of said sear assembly.

9. An archery release as defined in claim 8, wherein said sear assembly includes a sear and a toggle pivotally connected with said handle about parallel axes normal to the longitudinal axis, respectively, a first end of said sear engaging said trigger assembly and a second end of said sear engaging a first extension of said toggle, a second extension of said toggle engaging said bail keep.

10. An archery release as defined in claim 9, wherein said bail keep includes a first portion which engages said bail and a second portion which engages said toggle second extension, whereby tension of a bowstring on said bail during draw applies a retention force on said bail keep in a first direction and activation of said trigger assembly releases said sear which pivots said toggle to pivot said bail keep in a direction opposite said first direction to release said bail and fire an arrow.

11. An archery release as defined in claim 10, wherein said trigger assembly includes a trigger pivotally connected with said handle.

12. An archery release as defined in claim 11, wherein said trigger assembly further includes a spring connected with said handle to bias said trigger in a hold position.

13. An archery release as defined in claim 2, wherein said handle comprises a pair of concave mating handle portions which define an internal cavity which contains said sear assembly and at least a portion of said adjustment screw and said trigger assembly.

* * * * *